United States Patent [19]

Schlageter

[11] 4,316,499

[45] Feb. 23, 1982

[54] ROTARY, REGENERATIVE HEAT EXCHANGER HAVING FLOATING SEALING RINGS

[75] Inventor: Werner Schlageter, Saltsjö-Boo, Sweden

[73] Assignee: Svenska Rotor Maskiner Aktiebolag, Stockholm, Sweden

[21] Appl. No.: 140,678

[22] Filed: Apr. 16, 1980

[51] Int. Cl.[3] ..... F28D 19/00

[52] U.S. Cl. ..... 165/9; 165/10

[58] Field of Search ..... 165/8, 9, 10

[56] References Cited

U.S. PATENT DOCUMENTS 3,391,727 7/1968 Topouzian ..... 165/9
3,572,425 3/1971 Brandt et al. ..... 165/9
3,702,156 11/1972 Rohrs et al. ..... 165/10

FOREIGN PATENT DOCUMENTS 2802221 7/1979 Fed. Rep. of Germany ..... 165/10

*Primary Examiner*—Albert W. Davis
*Attorney, Agent, or Firm*—Frishauf, Holtz, Goodman & Woodward

[57] ABSTRACT

A rotary regenerative heat exchanger comprising an inner cylindrical post shell, an outer cylindrical shell interconnected with said inner shell by a radial partition wall, and rigid sealing rings at opposite ends of the outer shell. The outer or the inner end portion of each radial partition wall is slidingly adopted in an axial slot in the outer or inner shell, respectively, and the outer end portions of each partition wall are also slidingly engaging said sealing ring in a radial direction in order to isolate the floating sealing rings from the thermal deformation of the load carrying structure.

9 Claims, 7 Drawing Figures

ROTARY, REGENERATIVE HEAT EXCHANGER HAVING FLOATING SEALING RINGS

BACKGROUND OF THE INVENTION

This invention relates to rotary regenerative heat exchangers of the type comprising two main parts relatively rotatable with respect to each other about a common central axis, a first of said main parts constituting a regenerator body comprising an inner cylindrical post shell and an outer cylindrical shell interconnected with said inner shell by a plurality of radial partition walls forming a plurality of open-ended sectorial compartments containing a regenerative heat transferring mass providing passages for flow of fluid media therethrough from and to the ends of the regenerative body, and the second of said main parts constituting a duct part providing ducts having inlets and outlets for flow of heat emitting and heat absorbing fluid media to and from the opposite ends of said regenerator body, at least one of the ends of said outer shell being provided with a sealing ring positioned in the clearance between said main parts.

In rotary regenerative heat exchange apparatus of a common type referred to, a cylindrical rotor carrying the compartments of heat absorbent material is first exposed to a flow of heating fluid such as hot exhaust gas that is directed through a limited portion of the rotor. Upon rotating the rotor about its axis, the heated heat absorbent material is positioned in the path of a relatively cool fluid to be heated such as air, whereby the heat of the gas may be transferred thereto. The rotor is surrounded by a housing including a stationary duct part that simultaneously directs the heat emitting and heat absorbing fluids through spaced compartments of the rotor.

The rotor is subjected to a substantial temperature gradient whereby the structural components thereof warp and distort to the extent that effective sealing between the rotor and enclosing housing is difficult if not impossible to obtain.

It is therefore a primary object of this invention to provide a rotary regenerative heat exchanger whose sealing surfaces are not subject to the usual excesses of thermal distortion.

Due to a non-uniform temperature distribution, and especially under certain conditions, such as overload, the thermal deformation of the structural components, as the radial partition walls, often results in fracture of weld joints and other damage involving deformation of the sealing surfaces.

Therefore it is also an object of this invention to provide a rotor or regenerator body in which the weld joints are relieved from dangerous stresses.

A known regenerative heat exchanger having a cylindrical rotor carrying heat transfer material and having rigid sealing rings is shown in U.S. Pat. No. 2,981,521, and a similar heat exchanger is shown in British Pat. No. 1,376,122. In both cases the sealing rings are fixedly attached to rigid radial or diametric partition walls or webs the thermal expansion of which in the radial direction gives rise to deformation of the sealing rings.

Another known rotary regenerative heat exchanger is shown in British patent specification 1,046,16 in which the heavy heat transferring mass is supported by rigid radial diaphragms extending radially outward from the post shell to the concentric rotor shell forming a part of the sealing means and subjected to radial deformation forces.

SUMMARY OF THE INVENTION

The present invention provides a regenerator body structure that insolates the supporting structure from the sealing structure so that thermal deformation of the support structure does not give rise to any deformation of the rigid sealing ring. This has been achieved according to the invention in that the outer or the inner end of each radial partition wall is slidingly adopted in an axial slot in the outer or inner shell, respectively, the remaining end of each partition wall being fixedly attached to the corresponding outer or inner shell respectively, at least every second of the partition walls being of the type having its outer end slidingly connected to the outer shell, in addition to which said partition walls are also slidingly engaging said sealing ring in radial direction.

Although it is obvious that the invention is applicable to heat exchangers having a rotating component carrying the regenerative mass and a stationary component comprising fluid ducts, as well as to heat exchangers having a stationary component carrying the regenerative mass and a rotating component comprising fluid ducts, the following specification describes by way of example the first-mentioned kind of heat exchangers for the sake of simplicity.

DETAILED DESCRIPTION

Figure 1:
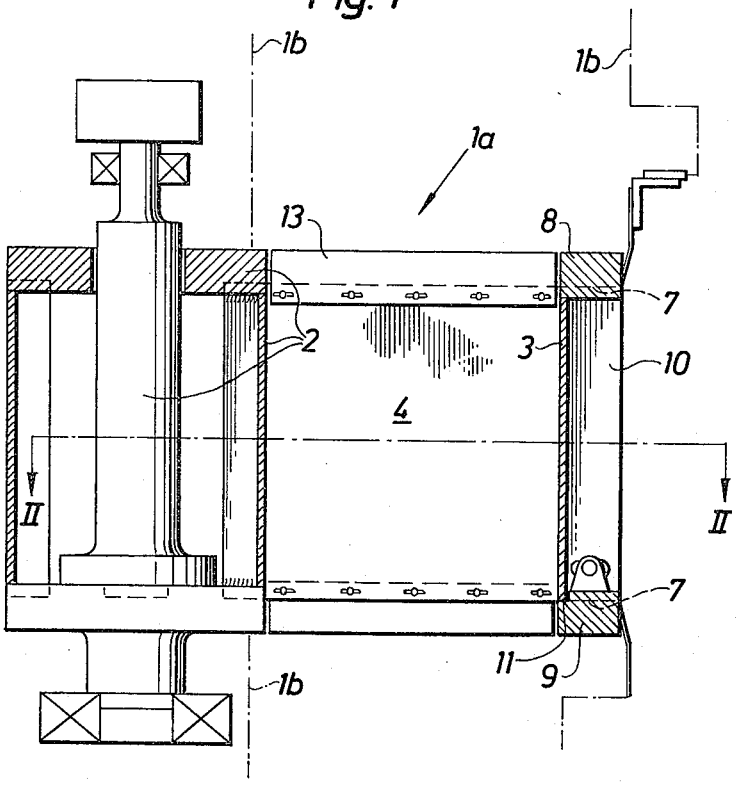
FIG. 1 is a sectional elevation view in diagrammatic form of a rotary regenerative heat exchanger constructed according to this invention.
Figure 2:
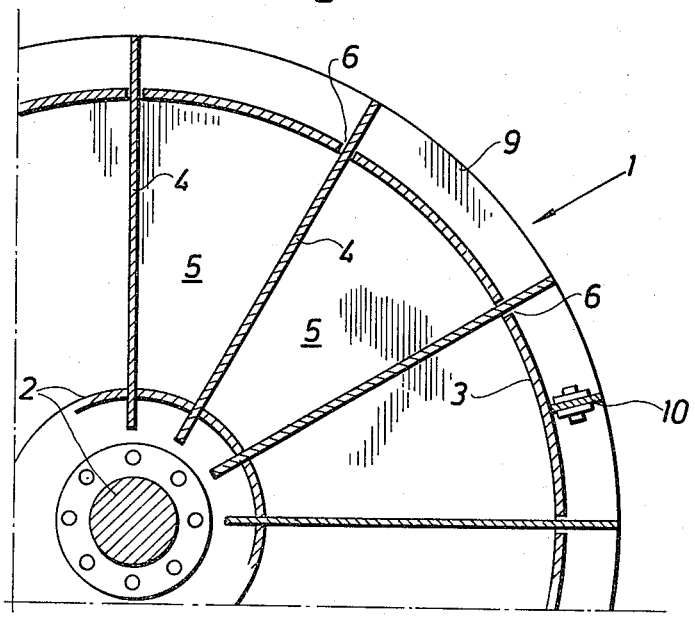
FIG. 2 is a plan view of the device as seen from section II—II in FIG. 1.

The rotary regenerative heat exchanger shown in FIGS. 1 and 2 comprises a rotor 1*a* having an inner cylindrical port shell 2 and an outer cylindrical shell 3 interconnected with said inner shell by a plurality of radial partition walls 4 forming a plurality of open-ended sectorial compartments containing baskets of heat transferring metal plates (not shown).

The partition walls 4 have inner ends welded to the rotor post and outer ends slidingly journalled in axial slots 6 in the outer shell 3 and in radial slots 7 of two rigid sealing rings 8, 9 sealingly connected to the spaced ends of the wall segments of the outer shell 3. The upper sealing ring 8 is welded to said wall segments and the lower sealing ring 9 is suspended by means of links 10 secured to the upper sealing ring 8. The lower sealing ring 9 is provided with a circular groove 11 receiving the bottom ends of the wall segments 3.

Thus, the outer ends of the radial partition walls 4 are displaceable radially in the axial slots 6 of the outer shell 3 and in the radial slots 7 of the sealing rings 8, 9. The sealing rings are positioned concentric to the inner shell 2 and outer shell 3 by the partition walls 4 which together with the slots 7 do not permit displacement of the sealing rings 8, 9 perpendicular to the radial partition walls 4 and the lower sealing ring 9 is suspended by means of links 10 secured to the upper sealing ring 8. The lower sealing ring 9 is provided with a circular groove 11 receiving the bottom ends of the wall segments 3.

Thus, the outer ends of the radial partition walls 4 are displaceable radially in the axial slots 6 of the outer shell 3 and the radial slots 7 of the sealing rings 8, 9. The sealing rings are positioned concentric to the inner shell 2 and outer shell 3 by the partition walls 4 which together with the slots 7 do not permit displacement of the sealing rings 8, 9 perpendicular to the radial partition walls 4.

The heat exchanger is provided with the usual sector plates 12 (FIGS. 3 and 4) at opposite ends of the rotor 1 and the radial partition walls are provided with flexible radial sealing members 13.

Figure 3:
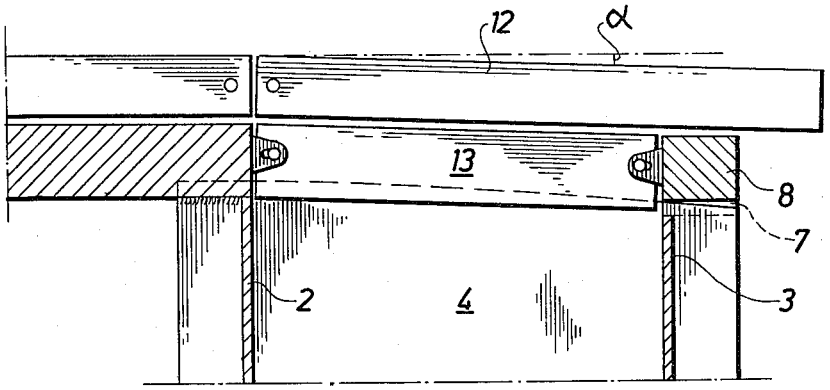
FIG. 3 is a fragmentary sectional view showing a portion of a sector plate and a sealing ring.

Under certain conditions a "turn-down" of the radial partition walls 4 takes place due to thermal deformation of the rotor structure. The sector plates 12 and radial sealing members 13 are also turned down by an angle, as shown in FIG. 3, but the rigid sealing rings 8, 9 and the outer shell segments 3 are not deformed but are only displaced a corresponding distance downwards.

Figure 4:
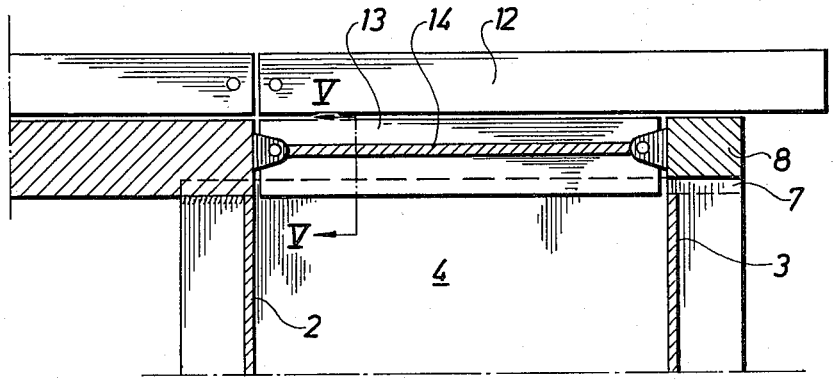
FIG. 4 is a similar view showing a special sealing ring centering device.
Figure 5:
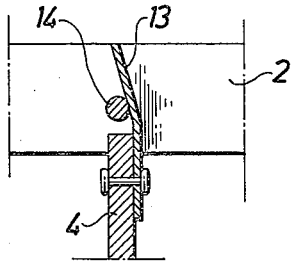
FIG. 5 is a section on line V—V in FIG. 4.

In FIGS. 4 and 5 at least the sealing ring 8 is connected to the rotor post by a centering device comprising a series of radially extending flexible wire-spokes 14. The spokes 14 may be used during the construction of the heat exchanger and may be removed after that.

Figure 6:
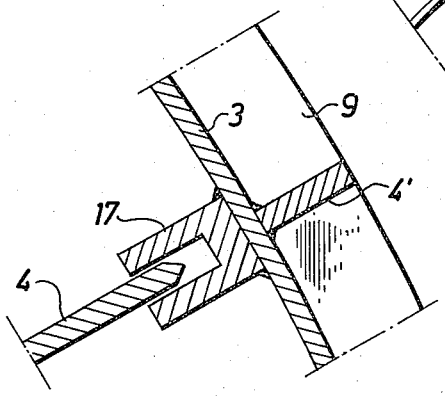
FIG. 6 is an enlarged fragmentary sectional view of a slip joint between a partition wall and the outer cylindrical shell.
Figure 7:
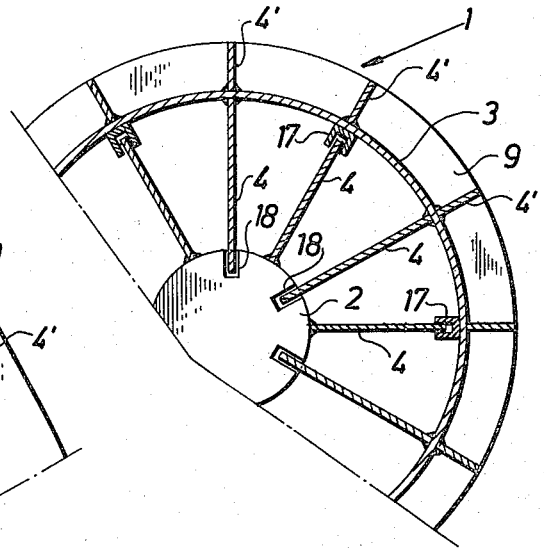
FIG. 7 is a fragmentary sectional plan view showing a further embodiment of the slip joint between partition walls and the outer and inner shells.

FIGS. 6 and 7 show another embodiment of the invention having an integral outer shell 3 in which interior axial channel members 17 are used to substitute for the outer shell segments 3 and slots 6. Every second partition wall 4 is welded to the inner post shell 2, each having its outer end portion slidingly received in one of the channel members 17 which is welded to the outer shell 3. The remaining partition walls 4 are welded to the outer shell 3 each having its inner end portion slidingly received in a corresponding axial slot 18 in the rotor post shell 2. In this case the upper sealing ring 8 is floatingly supported by the outer shell 3 guided only by exterior radial wall portions 4' welded on the outer shell 3 and forming extensions of the partition walls 4. It is also possible to arrange the partition walls 4 such that all partition walls 4 are fixedly attached, for instance welded, to the rotor post 2, and all other ends of the partition walls 4 are slidingly received in channel members 17.

It is to be understood that while several embodiments herein described and illustrated by way of example vary materially in their specific structural arrangements and modes of operation, all are embraced within the scope of the present invention which is to be construed as embracing all structures falling within the scope of the appended claims.

I claim:

1. In a rotary regenerative heat exchanger comprising first and second main parts relatively rotatable with respect to each other about a common central axis, a clearance being defined between said main parts, said first main part comprising a regenerator body (1) which includes an inner cylindrical post shell (2), an outer cylindrical shell (3), and a plurality of radial partition walls (4) interconnecting said outer shell (3) with said inner shell (2), said radial partition walls each having an inner end coupled to said inner shell (2) and an outer end coupled to said outer shell (3), said radial partition walls (4) forming a plurality of open-ended sectorial compartments containing a regenerative heat transferring mass providing passages for flow of fluid media therethrough from and to the ends of the regenerator body (1); said second main part comprising a duct part **(1*b*) providing ducts having inlets and outlets for flow of heat emitting and heat absorbing fluid media to and from the opposite ends of said regenerator body (1*a*); at least one of the ends of said outer shell (3) being provided with a sealing ring (8,9)** positioned in said clearance between said main parts;

the improvement comprising:

a plurality of axial slots (17) provided in at least said outer shell (3), the outer ends of at least every second radial partition wall (4) being slidingly located in a respective one of said axial slots in said outer shell, the other ends of each of said every second partition walls (4) being fixedly attached to the inner shell (2), each alternate radial partition wall, located between said every second partition walls, being slidably coupled at one side thereof to one of said inner and outer shells and being fixed to the other of said shells at the other side of said partition walls, said partition walls (4) further slidingly engaging said sealing ring (8,9) in the radial direction of said rotary regenerative heat exchanger.

2. The heat exchanger of claim 1, wherein said sealing ring (8,9) comprises a plurality of radial guiding means (7) for slidingly receiving radial edges of said respective partition walls (4).

3. The heat exchanger of claim 2, wherein said radial guiding means comprises a plurality of radial slots (7) formed in said sealing ring (8,9).

4. The heat exchanger of any one of claims 1–3 further comprising a plurality of axial slots (6,18) provided in said inner shell (2), said alternate radial partition walls being slidably coupled at one side thereof to a respective one of said axial slots in said inner shell, said alternate radial partition walls being fixed at the other ends thereof to said outer shell.

5. The heat exchanger of claim 4 wherein said slots in said outer shell comprise elongated openings (6) in said outer shell.

6. The heat exchanger of any one of claims 1—3 wherein said slots in said outer shell comprise elongated openings (6) in said outer shell.

7. The heat exchanger of claim 4 wherein said slots in said inner shell comprise axially extending recesses (18) in said inner shell.

8. The heat exchanger of any one of claims 1–3 wherein all of said radial partition walls (4) at one end are slidably located in a respective one of axial slots in said outer shell, the other ends of said partition walls being fixedly attached to said inner shell (2).

9. The heat exchanger of claim 8 wherein said slots in said outer shell comprise elongated openings (6) in said outer shell.

* * * * *